United States Patent [19]

Levenberg

[11] Patent Number: 4,573,736

[45] Date of Patent: Mar. 4, 1986

[54] CHAIR FOR HANDICAPPED PERSONS

[76] Inventor: Nat Levenberg, 2 Windsor Pl., Lynbrook, N.Y. 11563

[21] Appl. No.: 646,811

[22] Filed: Sep. 4, 1984

Related U.S. Application Data

[63] Continuation-in-part of Ser. No. 564,555, Dec. 22, 1983, Pat. No. 4,538,853.

[51] Int. Cl.[4] ..... A47C 1/02

[52] U.S. Cl. ..... 297/339; 297/337; 297/DIG. 10

[58] Field of Search ..... 297/DIG. 10, 347, 345, 297/337, 338, 339; 4/251, 241

[56] References Cited

U.S. PATENT DOCUMENTS

| | | | |
|---|---|---|---|
| 1,025,915 | 5/1912 | Hoff | 297/332 |
| 2,442,303 | 5/1948 | Mayfield | 297/DIG. 10 |
| 2,869,623 | 1/1959 | Poulin | 297/DIG. 10 |
| 3,479,086 | 11/1959 | Sheridan | 297/330 |
| 3,623,767 | 11/1971 | London | 297/DIG. 10 |
| 3,640,566 | 2/1972 | Hodge | 297/68 |
| 3,902,755 | 9/1975 | Sirot | 297/339 |
| 3,915,494 | 10/1975 | Sommerset | 297/339 |

FOREIGN PATENT DOCUMENTS

| | | | |
|---|---|---|---|
| 494034 | 1/1978 | Australia | 297/DIG. 10 |
| WO/8203320 | 10/1982 | PCT Int'l Appl. | 297/DIG. 10 |

*Primary Examiner*—James T. McCall

*Attorney, Agent, or Firm*—Charles E. Temko

[57] ABSTRACT

A chair with resilient means for assisting an occupant in raising himself to a standing position. The seat cushion pivots relative to the chair frame about an axis near the rearward edge thereof, movement serving to at least partially simultaneously elevate the arm rests as well. When the chair is occupied, resilient struts are compressed; and the seat may be manually locked in position against strut compression.

2 Claims, 6 Drawing Figures

CHAIR FOR HANDICAPPED PERSONS

RELATED APPLICATION

This application is a continuation-in-part of my copending application Ser. No. 564,555 filed Dec. 22, 1983, now U.S. Pat. No. 4,538,853.

BACKGROUND OF THE INVENTION

This invention relates generally to the field of specialized furniture suitable for use by invalids and relatively infirm persons, and more particularly to an improved form of chair having means for assisting an occupant to gain a sitting as well as a standing position. Devices of this general type are well known in the art, and the invention lies in specific constructional details which permit ease of manufacture at relatively low cost, and improved facility in use by the occupant.

The most commonly used type of such chair in the prior art is one in which the seat bottom is hingedly associated with the chair frame adjacent a forward edge thereof. A hydraulic or pneumatic lifting means is either electrically or manually powered, and when actuated, the occupant is raised with the seat to a standing position as the seat bottom moves from horizontal to vertical orientation. Such constructions are not without substantial utility, particularly in the area of use by relatively feeble and/or grossly overweight persons. However, they are expensive to construct, and, depending upon the quality of manufacture, they are more or less reliable. They suffer a substantial disadvantage in that upon the occurrence of a power failure, electrically powered types become at least temporarily inoperative. Hand powered hydraulic types, somewhat similar to a barber's chair, often require manual exertion for operating far above the ability of the user, and are thus suitable only for use with an attendant.

The above described constructions have been used primarily in homes, or patient's rooms in nursing hospitals on a personal basis where the occupant often spends the better part of the day. The high cost of manufacture normally prohibits the provision of large numbers of such chairs and the placing of the same about the private or nursing home.

Many occupants of nursing homes, as well as those living in private homes, do possess a degree of ambulatory ability, but find that it requires more than normal effort to sit or arise from a conventional chair. These persons, once erect, can walk with some assistance from one location to another where they will again sit down in another chair at another location. Such persons do not require powered chairs at each location and, indeed, the cost of such chairs in plural numbers is usually prohibitive.

The use of unpowered chairs which rely upon compressed springs to elevate a seated individual to standing position are not unknown. An interesting construction is disclosed in the U.S. Pat. No. 1,025,915 to E. J. Hoff, granted May 7, 1912. The disclosed structure includes a seat supported on an articulated linkage having a principal pivot point located several inches rearwardly at the front edge of the seat. The linkage extends beyond the pivot point, and is engaged by a pair of very powerful springs, the tension of which is adjustable. The springs are always under substantial tension, which is increased as the seat is lowered under the weight of the occupant, and means is provided for locking the seat in lowered position such that the locking means cannot be released unless the occupant is sitting on the seat, thereby avoiding accidental movement of the seat from lowered to raised position, with possible injury to a bystander. The complexity of the construction, coupled with the fact that the force exerted by the springs under tension, is many times that of the weight of the occupant, forces the construction of the chair to be unreasonably heavy as well as expensive, and, as a result, this type of chair construction has not gained public acceptance.

SUMMARY OF THE INVENTION

Briefly stated, the invention contemplates the provision of an improved chair construction for physically handicapped persons, in which the use of powered lifting devices has been eliminated, and in which lifting forces are obtained solely from potential energy stored in resilient elements at the time the user is first seated. The construction includes means for locking the resilient elements in fixed position during the period in which the user is seated to be released by the user when he wishes to leave the chair. As contrasted with prior art constructions offering similar facility, the resilient elements are under substantially no tension in the absence of the user upon the seat bottom, and by locating the pivot axis of the seat adjacent the rearward edge of the seat cushion and positioning the resilient elements to have a substantially, vertical line of action, the forces involved are considerably reduced with the accompanying possibility of manufacturing the entire chair of relatively light weight materials so as to be easily portable. I have found that by incorporating my invention into a generally conventional tubular frame-type chair, the additional cost involved represents only a small portion of the entire cost of manufacture of the chair. The tubular construction provides lighter weight, however, the same operating chair could be constructed as a more decorative unit of wood, or upholstery. The weight would be heavier, and construction would be more economical, other than the decorator upholstered item. The shipping costs would be higher. Further, because the movement of the chair seat bottom from lowered to raised position represents only a maximum of 6 to 8 inches which would be prearranged by the movement of the assisting springs to be either further back to raise the seat higher, or be placed further forward for a shorter person, and not raise the arms and seat as high, there is little or no danger involved should the seat be accidentally released without the presence of an occupant. Most importantly, the seat is so designed that the user may shift his weight forwardly on the seat bottom prior to releasing the resilient elements, so that the resilient elements, upon upward expansion, raising the seat bottom may utilize maximum mechanical advantage. Thus, the spring modulus of such elements may be substantially reduced as contrasted with earlier, more complicated constructions. For example, in the case of an occupant weighing approximately one hundred fifty pounds, the total force required to fully compress the resilient elements can be as little as forty to fifty pounds. The raising of the seat bottom about its rearward edge also serves to elevate the arm rests, so that lifting force is imparted not only to the pelvic portions of the user, but to the arms as well, thus providing improved support as the user moves to a standing position. Because of the relatively light weight of the completed chair, large numbers of the same can be provided in an institution, at relatively low cost, and can be readily moved by service personnel to the desired locations. Chairs may be manufactured to include resilient elements having different spring moduli, which may be clearly marked on a visible surface to assist users in selecting a proper chair, as well as having provisions for adding or subtracting springs of the same relative resistance.

BRIEF DESCRIPTION OF THE DRAWINGS

In the drawing, to which reference will be made in the specification, similar reference characters have been employed to designate corresponding parts throughout the several views.

DETAILED DESCRIPTION OF THE DISCLOSED EMBODIMENT

Figure 1:
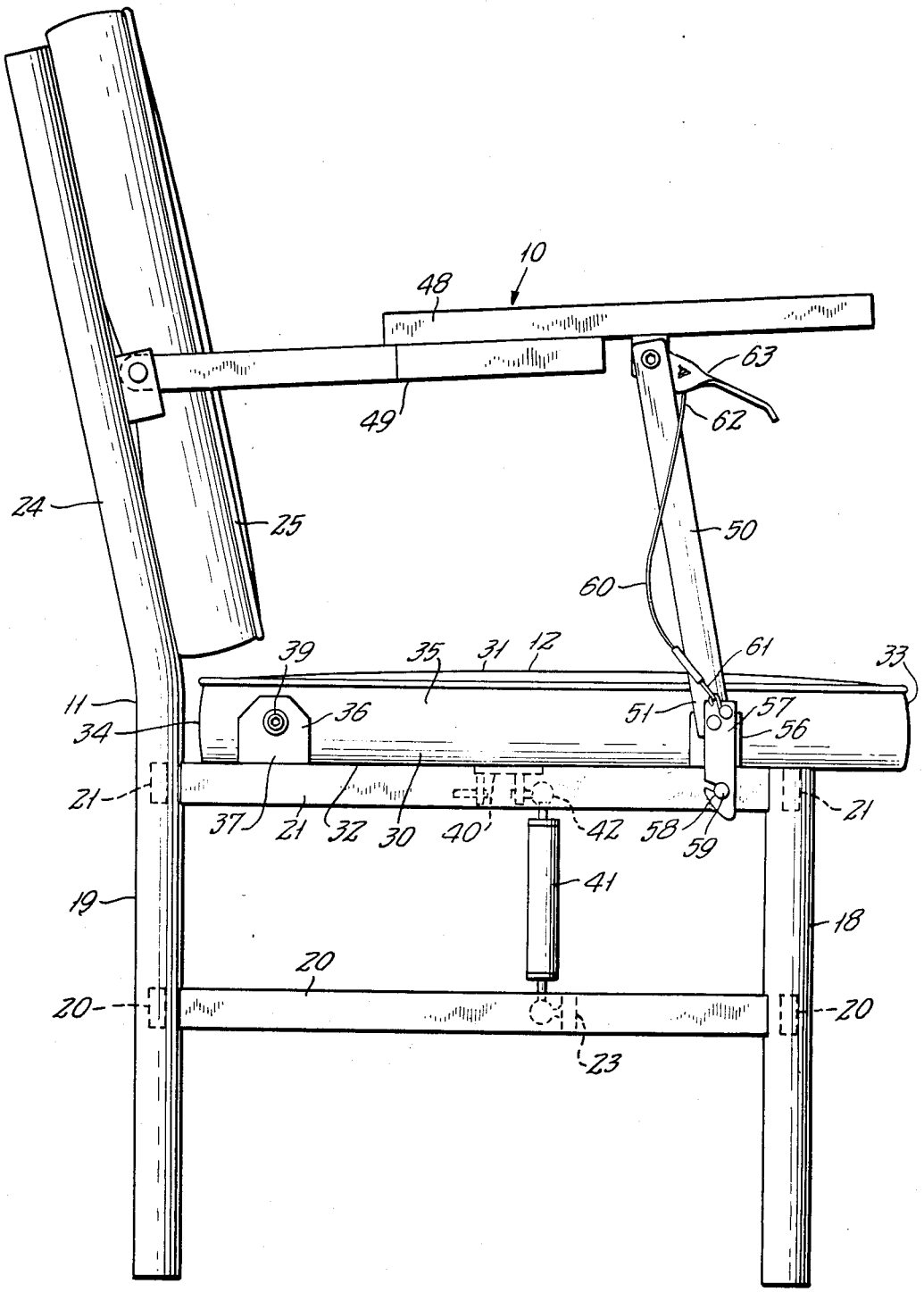
FIG. 1 is a side elevational view of an embodiment of the invention.

In accordance with the invention, the device, generally indicated by reference character 10, comprises broadly: a frame element 11, and a movable seat element 12.

The frame element 11 may be of generally conventional construction, and, for example, may consist of welded metallic tubing. It includes a pair of front leg members 18, a pair of rear leg members 19, a pair of lateral brace members 20, a pair of lateral upper members 21, a pair of transverse upper members 22, and a single transverse member 23, which anchors one end of resiliently compressible struts to be described hereinbelow. The rear leg members 19 include angularly disposed extensions 24 for supporting a rear seat cushion 25 in conventional manner.

The movable seat element 12 includes a framed and padded seat bottom 30, bounded by an upper surface 31, a lower surface 32, a forward edge surface 33, a rearward edge surface 34, and a pair of side surfaces 35. Supporting brackets 36 are connected to upper members 21 at lower ends 37 thereof. The upper ends 38 are connected by pintles 39 near the rearward edge surface 34 to the seat bottom 30.

Figure 2:
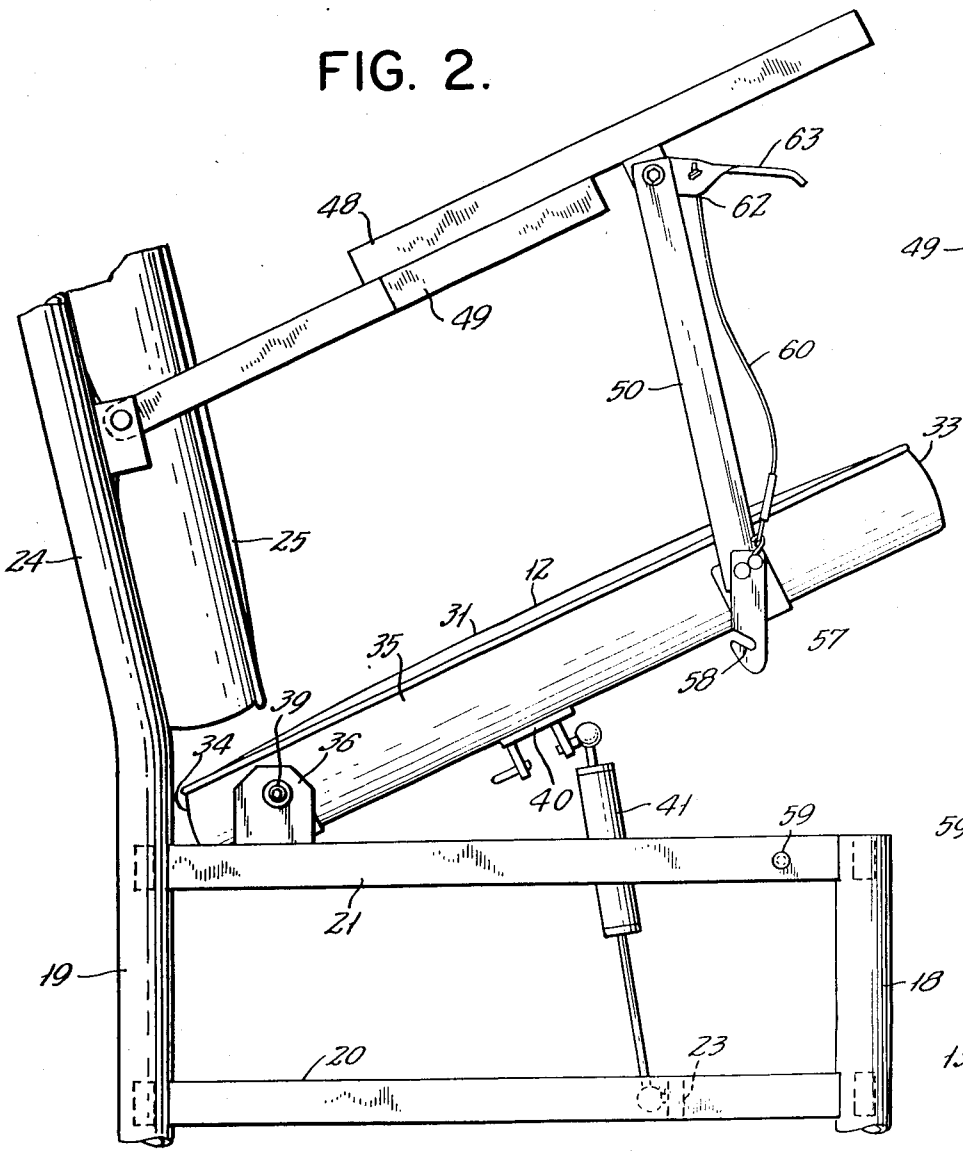
FIG. 2 is a fragmentary side elevational view thereof, showing certain of the component parts in altered relative position.

Mounted on the lower surface 32 is a transverse member 40 engaging the upper end of each of plural gas-filled struts 41. The upper end 42 may be interconnected by ball joints, while the lower end 43 may be interconnected by simple pintle means interconnected to one side of the transverse lower member 23. As will be observed from a comparison of FIGS. 1 and 2 in the drawing, the actual expansion and contraction of the struts 41 is relatively short, in the order of 3 to 4 inches, to result in movement of the front edge of the seat bottom 30 between 6 to 8 inches, depending upon the position of attachment of the upper ends 42 of the struts. Because the struts 41 are direct acting against the under surface of the seat bottom 30, the lifting force will be greatest when the seat bottom is in fully lowered condition, thereby providing maximum impetus when the user first begins to move to a standing position.

A pair of arm rests 48 are supported on a horizontal strut 49 pivotally interconnected to the frame member 24, and to a vertical strut 50 at a forward end. The lower end 51 interconnects with the seat bottom 30, so that as the seat bottom is raised, the forward end of the arm rests will move an equivalent distance. The resistance force would be approximately 75% of the person's weight. Thus removing the calculated weight of the legs, the remaining lifting weight would be approximately 15 to 20% of the person's entire weight.

As is desirable with this type of construction, the seat bottom 30 is selectively lockable in lowered condition during occupancy by a user. To this end, a strut 56 on the vertical strut 50 supports a pivotal latch member 57 having a recess 58 adapted to engage a corresponding strut 59 on each of the lateral upper members 21. The latch 57 is operated by a cable 60, the lower end 61 of which engages an opening in the latch 57, the upper end 62 engaging a pivotally mounted lever 63 positioned beneath the forward end of each of the arm rests so as to be conveniently operated by the user.

The sitting and rising motions of the user are somewhat different than that involved in use of prior art devices, and is predicated upon the fact that the device will be used by persons having some degree of ambulatory movement. During sitting, the user grasps the arm rests 48, and sits on the seat bottom 30 such that he contacts essentially the forward part of the seat bottom in the area of the vertical struts 50. This will enable his weight to have maximum force in compressing the gas-filled struts 41, and when the seat bottom 30 has reached horizontal position, the latches 57 are released so as to engage the corresponding struts 59. Once this has been accomplished, the user then slides his body rearwardly until his back contacts the rear cushion 25. While the seat bottom is in locked condition, he may shift his position as often as desired or required. When it is desired to leave the chair and assume a standing position, the user slides his body forwardly, so that the pelvis rests only on the forward portion of the seat bottom, and, while grasping the arms rests, the latches 57 are released to permit the struts 41 to expand. This results in an upward movement of between 6 to 8 inches of the forward end of the seat bottom 30, with maximum force exerted at the commencement of movement, as is desirable to overcome initial inertia. As has been mentioned, where the user has a weight of approximately 150 pounds, the net lifting force at forward edge surface 33 may be as little as 40 to 50 pounds, this being sufficient to enable the user to rapidly arise from the chair in complete comfort. The resistance force would be approximately 75% of the person's weight. Thus removing the calculated weight of the legs, the remaining lifting weight would be approximately 15 or 20% of the person's entire weight.

In the case of heavier occupants, the chair can be readily adapted for their use by merely substituting struts 41 of greater spring modulus, or more struts.

It will be observed that the total movement in raising the seat bottom is governed essentially by the limits of travel of the struts 41 themselves, so that no other movement limiting means is necessary. During the lowering movement, the initial force required to commence deflection will normally be only slightly more than half of the total force required to fully depress the seat bottom, as will be normal as the user transfers his weight from his legs to the seat cushion. The reverse will be true as he arises. The same chair could be used by any given patient for as long as necessary. Should the necessity arise to make the chair more accessable for a completely or slightly different structured person, at that point, springs can be added or subtracted, or even moved, and at that time could there be the necessity of using heavier springs. (Five regular springs would provide approximately 150 pounds at the upper level.)

Figure 3:
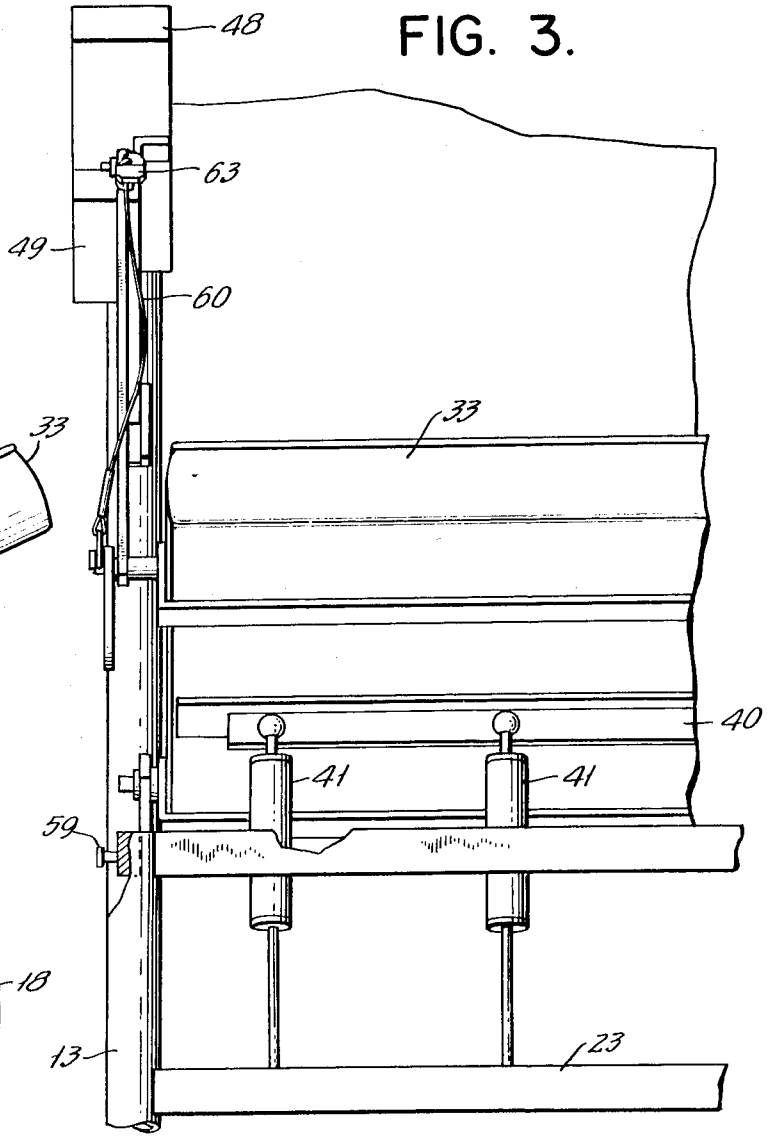
FIG. 3 is a fragmentary front elevational view as seen from the right hand portion of FIG. 2.

Turning now to FIGS, 4, 5, and 6 which illustrate an alternate form of the embodiment, parts corresponding to those known in the principal embodiment (FIGS. 1–3), have been designated by similar reference characters, with the additional prefix "1".

Figure 4:
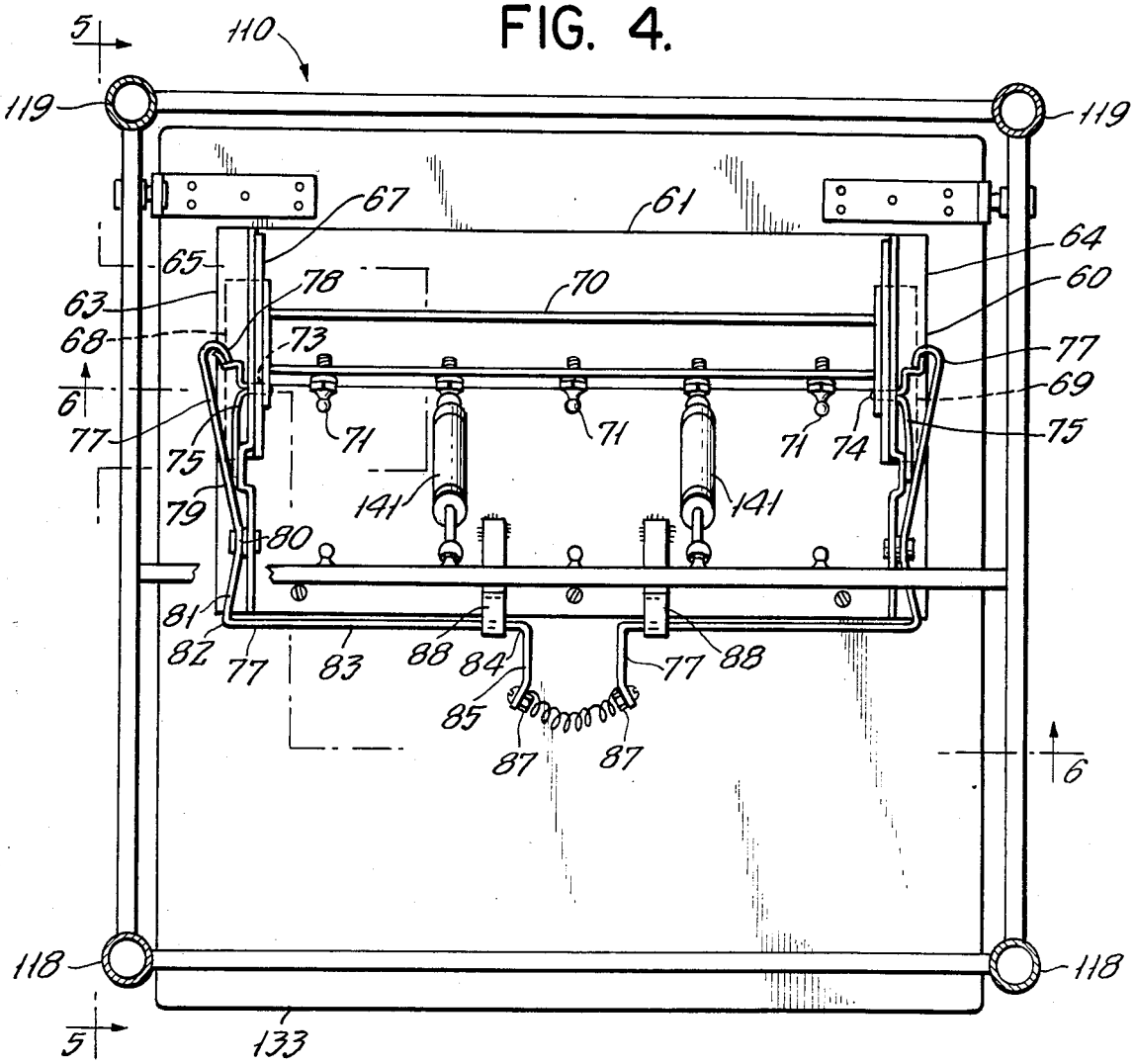
FIG. 4 is a bottom plane view of an alternate construction.
Figure 6:
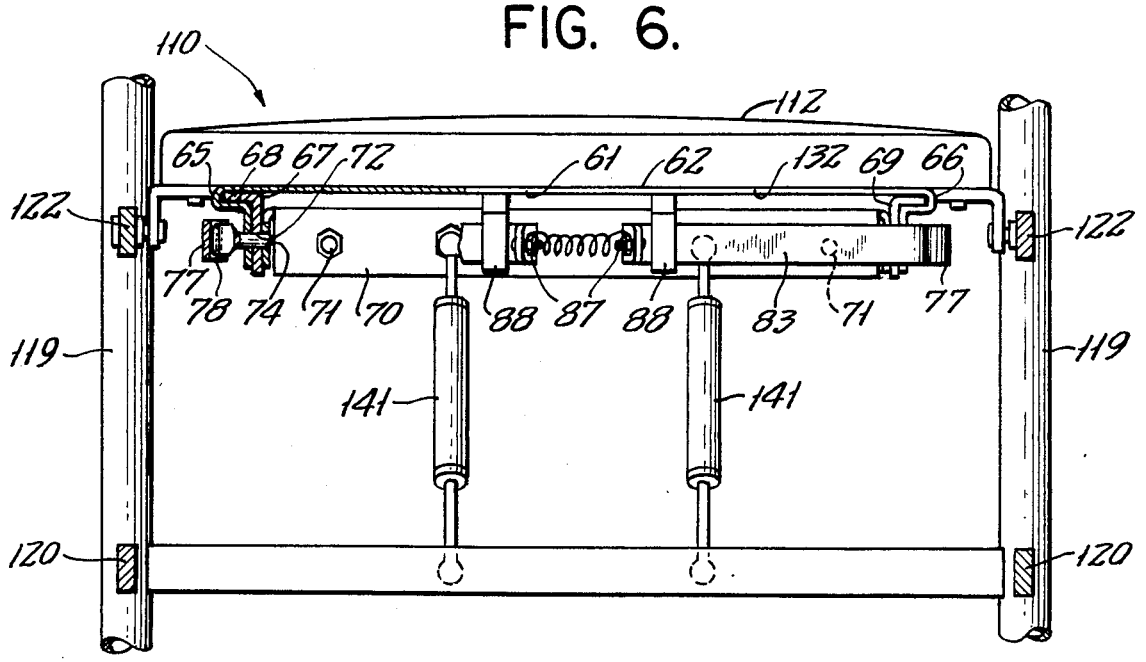
FIG. 6 is a front elevational view of the alternate construction.
Figure 5:
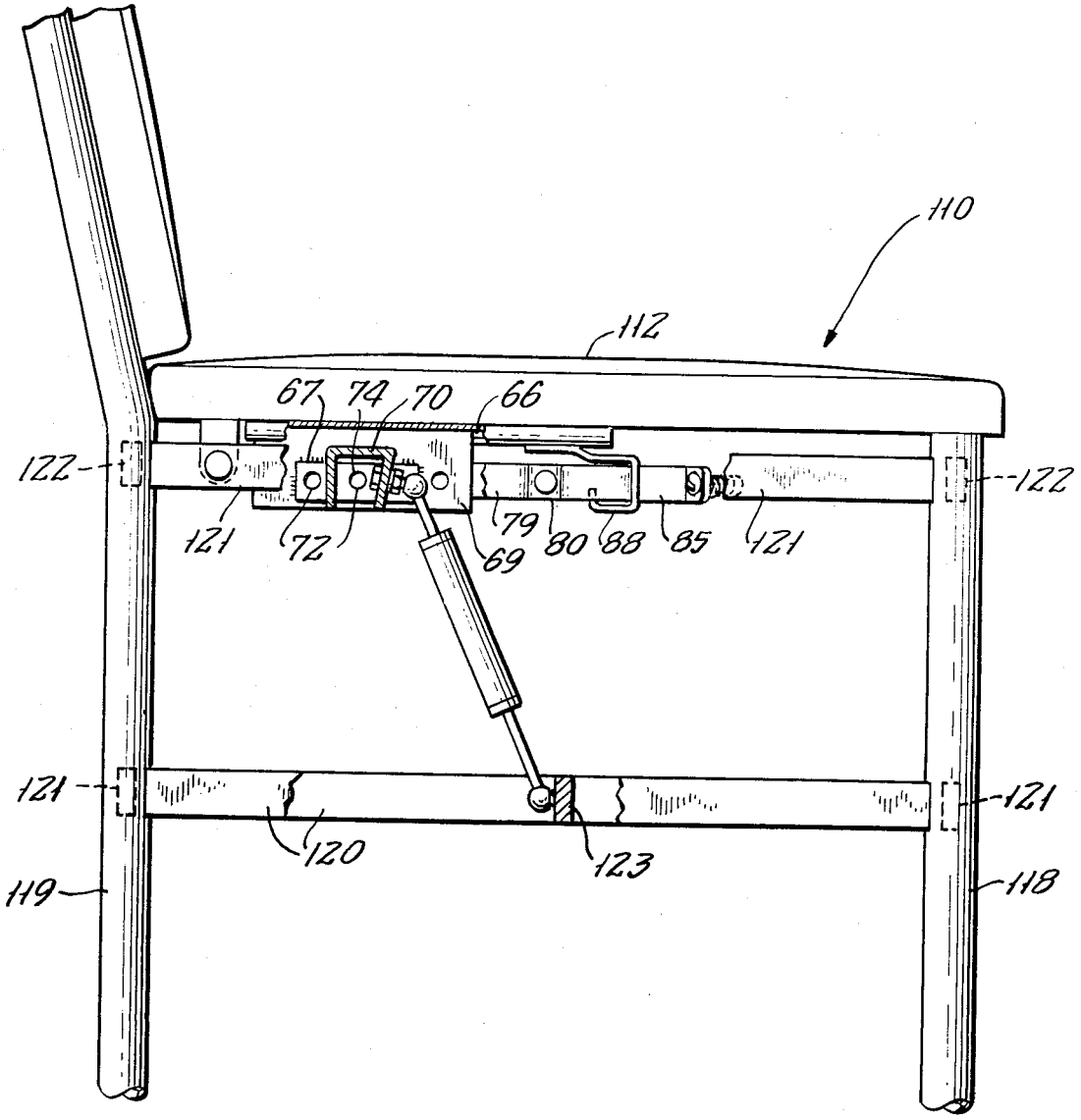
FIG. 5 is a side elevational view of the alternate construction.

The construction illustrated in FIGS. 4–6 is characterized in the provision of an improved adjustment element generally indicated by reference character 60 for the purpose of altering the net force required to effectively compress the compressible members in bringing the seat cushion to a horizontal position. This is accomplished by shifting the position of the upper ends of the compressible members 141 relative to the pivotal axis of the seat cushion. Although the construction shown illustrates the shifting of the upper ends of the compressible members, it will be readily apparent to those skilled in the art, that, where desired, the same adjustment means may be employed to shift the lower ends of the compressible elements as well.

The element 60 includes a fixed frame element 61 which may be in the form of a metalic stamping, an under surface 62 of which is secured to the bottom of the seat cushion. This element is bounded by lateral edges 63 and 64 which form guideways 65 and 66 to accommodate in sliding relation a second element 67. The element 67 includes corresponding side members 68 and 69 which are disposed within the guideways 65 and 66 respectively, and which are interconnected by a transversely disposed member 70 of U-shaped cross section. A series of ball joints 71 interconnecting with the upper ends of the compressible members is carried by the member 70.

The side members 68 and 69 are provided with a series of openings 72 which are selectively alignable with a single opening 73 in the guideways 65 and 66. Locking pins 74 are carried by resilient members 75, and are adapted to penetrate, on each side the single opening 73 and one of the series of openings 72 to selectively fix the relative positions between the first and second element 61 and 67.

To facilitate withdrawal of the locking pins 74, there is provided a pair of release members 77, each including a terminal hook 78 engaging the flat spring supporting the respective locking pins 74. The hooks 78 is carried by a rectilinear portion 79 joining a bent portion 80 which forms a pivot axis, a second rectilinear member 81, a second bent portion 82, a third rectilinear portion 83 and a third bent portion 84 terminating in a terminal portion 85. The oppositely positioned portions 83 are interconnected by a coil spring which surrounds mutually abuttable stop members 87. Brackets 88 maintain the release members 77 for limited pivotal motion.

To readjust the position of the element 67 relative to the element 61, it is necessary only to squeeze the members 83 toward each other, and while maintaining this position to slide the element 67 relative to the element 61 following which release of the members 83 causes the spring 86 to return the parts to unstressed condition, permitting the locking pins 74 to again reenter one of the series of openings 72, and lock the members in the new position.

I wish it to be understood that I do not consider the invention limited to the precise details of structure shown and set forth in this specification, for obvious modifications will occur to those skilled in the art to which the invention pertains.

I claim:

1. A chair construction for use by handicapped persons comprising: a relatively rigid frame element and a movable seat element; said frame element including a plurality of frame members providing a fixed horizontal platform at normal seat height and a fixed back cushion disposed in generally vertical orientation at one side of said platform; a seat bottom cushion mounted on said platform for pivotal movement on an axis parallel to an adjacent rear transverse edge thereof; a plurality of resiliently compressible members interconnecting said frame element and an under surface of said bottom cushion forwardly of said axis; a pair of arm rests each including a pivotally interconnected horizontal and vertical strut; said horizontal strut being pivotally connected at the rear end thereof to said back cushion, said vertical strut being connected at a lower end to said seat cushion forwardly of said resiliently compressible members; and such chair construction further characterized in the provision of adjustable means for shifting the points of interconnection of said resiliently compressible members along a forward-rearward axis to vary the distance of said points relative to said first mentioned axis, and thereby vary the effective force on said bottom cushion necessary to move said bottom cushion to horizontal condition; whereby upward movement of said seat cushion results in corresponding movement of said arm rests; and locking means manually controllable from said arm rests for fixing the position against the compressive force of said resiliently comrpessible elements.

2. A chair construction in accordance with claim 1, said adjustable means including a first element secured to said bottom cushion, a second element slidably engaged upon said first element, and selectively locked in fixed relation thereto, said second element pivotally mounting one end of said compressible members.

* * * * *